US008607898B2

(12) United States Patent
Rodgers

(10) Patent No.: US 8,607,898 B2
(45) Date of Patent: Dec. 17, 2013

(54) FORCE COMPENSATOR FOR TOP DRIVE ASSEMBLY

(75) Inventor: Troy A. Rodgers, Chickasha, OK (US)

(73) Assignee: Rodgers Technology, LLC, Chickasha, OK (US)

( * ) Notice: Subject to any disclaimer, the term of this patent is extended or adjusted under 35 U.S.C. 154(b) by 225 days.

(21) Appl. No.: 13/114,722

(22) Filed: May 24, 2011

(65) Prior Publication Data

US 2012/0125692 A1 May 24, 2012

Related U.S. Application Data

(60) Provisional application No. 61/348,113, filed on May 25, 2010.

(51) Int. Cl.
*E21B 3/02* (2006.01)
*E21B 19/16* (2006.01)

(52) U.S. Cl.
USPC ..... 175/113; 175/195; 166/85.1

(58) Field of Classification Search
USPC ..... 175/113, 170, 172, 195, 162, 220; 166/85.1, 78.1
See application file for complete search history.

(56) References Cited

U.S. PATENT DOCUMENTS 7,493,970 B1 * 2/2009 McKnight et al. ..... 175/113

* cited by examiner

*Primary Examiner* — William P Neuder
(74) *Attorney, Agent, or Firm* — Dunlap Codding, P.C.

(57) ABSTRACT

A force compensator for a top drive assembly includes a carrier block, a pair of top drive link assemblies, a mandrel, and a shock absorber assembly. The top drive link assemblies being positionable on either side of a power swivel and having a lower end connectable to the power swivel, an upper end connected to the carrier block, and being slidably positionable on a derrick of a drilling rig. The mandrel is slidably disposed through the carrier block and has an upper end connectable to a mover assembly of the drilling rig. The shock absorber assembly is interposed between the carrier block and a lower end of the mandrel in such a way that the shock absorber assembly is movable between an expanded condition and a compressed condition.

18 Claims, 7 Drawing Sheets

FORCE COMPENSATOR FOR TOP DRIVE ASSEMBLY

CROSS REFERENCE TO RELATED APPLICATIONS

This application claims priority to the provisional application identified by U.S. Ser. No. 61/348,113, filed May 25, 2010, the entire contents of which are expressly incorporated herein by reference.

BACKGROUND OF THE INVENTION

1. Field of the Invention

The inventive concepts disclosed herein generally relate to well tubing handling systems, and more particularly, but not by way of limitation, to an apparatus for absorbing force for a top drive assembly used to rotate a drill string.

2. Brief Description of Related Art

It is known in the petroleum industry to use top drive systems to rotate a drill string to form a borehole. Top drive systems are equipped with a motor to provide torque for rotating the drill string. Top drive systems are capable of being raised and lowered along a substantially vertical axis directly above the borehole. Additionally, a length of drill pipe is connected to the top drive system so as to extend downwardly therefrom in a substantially vertical direction, and a drill bit is secured to the downward end of the drill pipe.

When drilling a borehole, the top drive system is activated so as to rotate both the drill pipe and the drill bit at the desired speed. Then, the top drive system, together with the drill pipe and bit, is lowered. When the drilled hole is deep enough to accommodate the first length of drill pipe, the top drive system is disconnected from the drill pipe and raised to its original position. A second length of drill pipe is then connected between the top drive system and the first length of drill pipe, thereby increasing the effective length of the drill string. Thereafter, the top drive system is again activated, and the drilling operation is continued. This procedure is then repeated until the desired hole depth is achieved.

One of the problems encountered during the process of adding additional joints of drill pipe is that the weight of the top drive system and a joint of pipe suspended from the top drive assembly results in a significant force being applied to the threads as the new joint of drill pipe is stabbed into, or otherwise brought into engagement with, the top end of the joint to which it is desired to make a connection. This significant force can result in damage to the threads of the drill pipe, thereby increasing the costs due to downtime and costs associated with repairing the threads of the drill pipe.

To this end, a need exists for an apparatus that can absorb the force between a top drive assembly and an adjacent joint of pipe so as to alleviate damage to one or both. It is to such an apparatus that the present invention is directed.

DETAILED DESCRIPTION OF EXEMPLARY EMBODIMENTS

Figure 1:
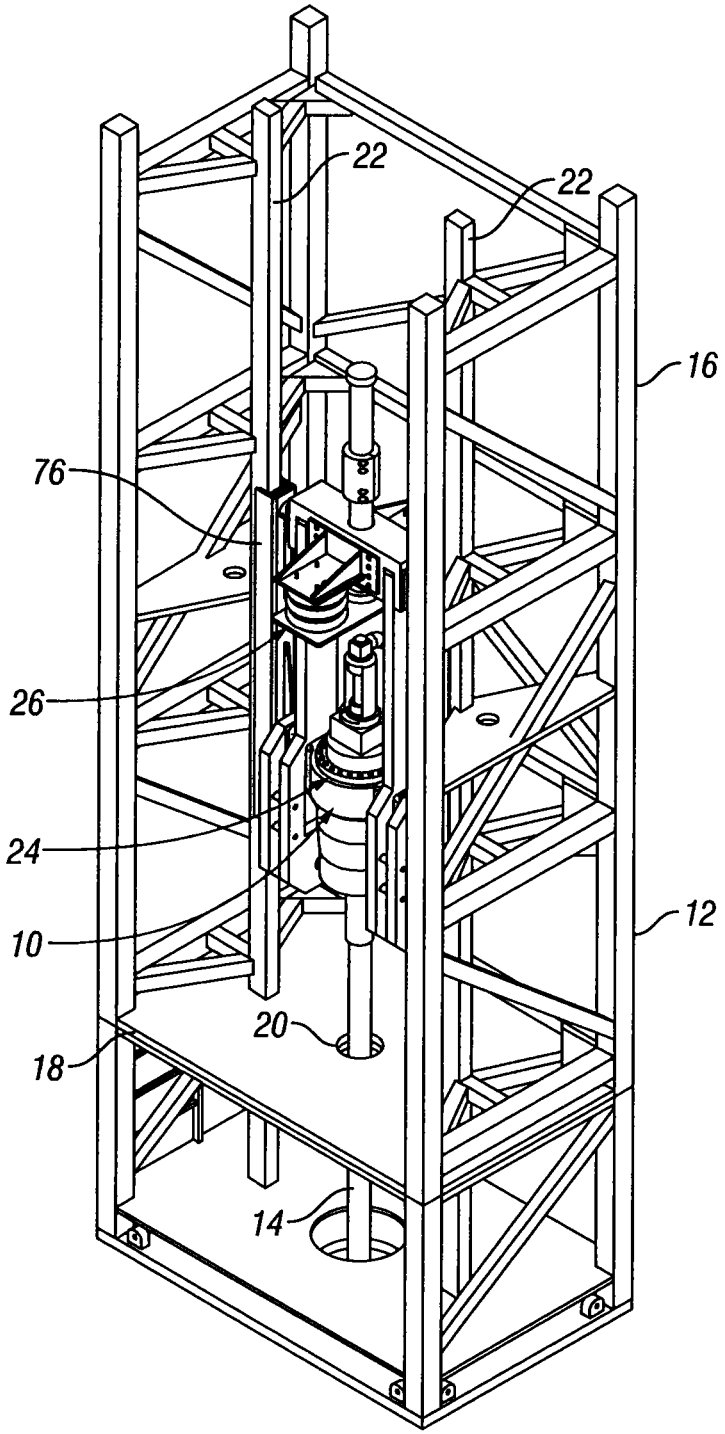
FIG. 1 is a perspective view of a portion of a rig derrick with a top drive assembly constructed in accordance with the present invention
Figure 2:
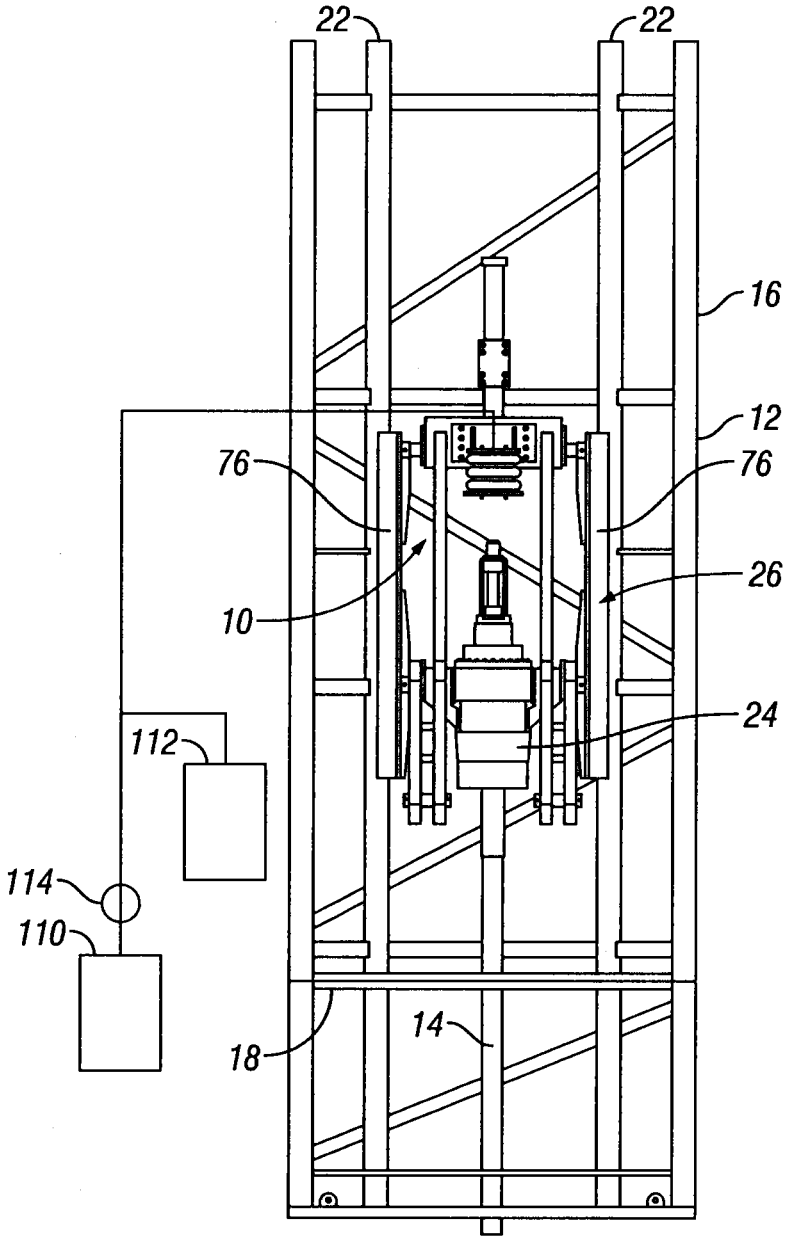
FIG. 2 is an elevational view of rig derrick of FIG. 1.

Referring now to the drawings, and more particularly to FIGS. 1 and 2, a top drive assembly 10 constructed in accordance with the inventive concepts disclosed herein is shown mounted on a drilling rig 12 which is used in assembling pipe strings, such as drill string 14. The drilling rig 12 includes a derrick 16 having a rig floor 18 at its lower end containing an opening 20 through which drill string 14 extends downwardly into the earth to drill a well. The drill string 14 is formed in the usual manner from a plurality of pipe sections interconnected at threaded joints and having a bit (not shown) at the lower end of the drill string 14. The drill string 14 is driven rotatively by the top drive assembly 10 which is connected to the upper end of the drill string 14 and moves upwardly and downwardly along a vertical axis of the well. The top drive assembly 10 is guided for vertical movement along the vertical axis by two vertical guide rails or tracks 22 rigidly attached to derrick 16. The top drive assembly 10 moves along the guide rails in manner to be described in detail below.

The top drive assembly 10 includes a power swivel 24 and a force compensator 26. The power swivel 24 is used to rotate the drill string 14 to drill a well hole. A variety of power swivels may be employed, such as a power swivel commercially available from Venturetech of Houston, Tex. The power swivel 24 generally includes a drive motor 28 and a top drive output shaft 30 extending downwardly from the drive motor 28, with the drive motor 28 being operative to rotate the drive shaft, as is conventional in the art. Drilling fluid is introduced into the upper end of the drill string 14 through a swivel (not shown) connected to the upper end of power swivel 24.

Figure 8:
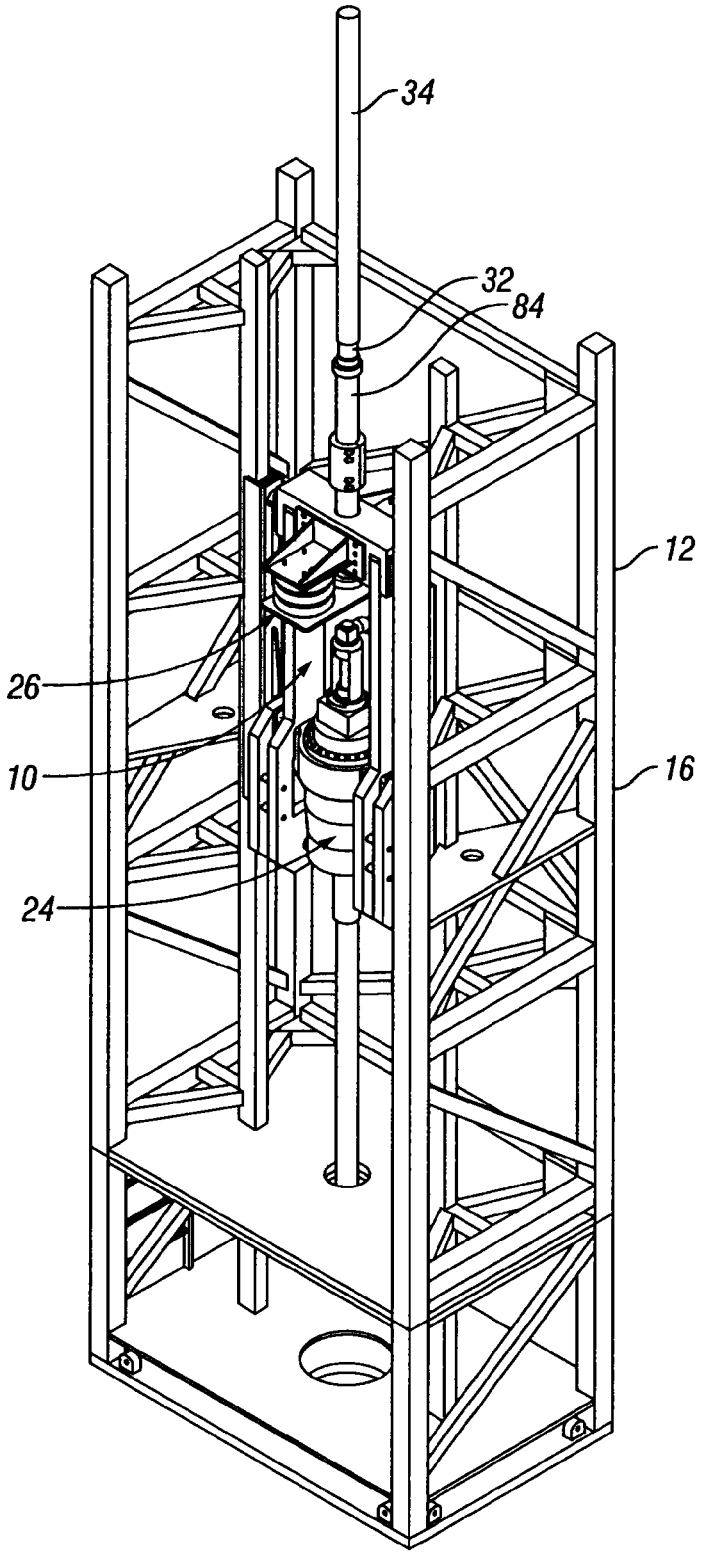
FIG. 8 is a perspective view of the top drive assembly shown connected to a hydraulic cylinder.
Figure 9:
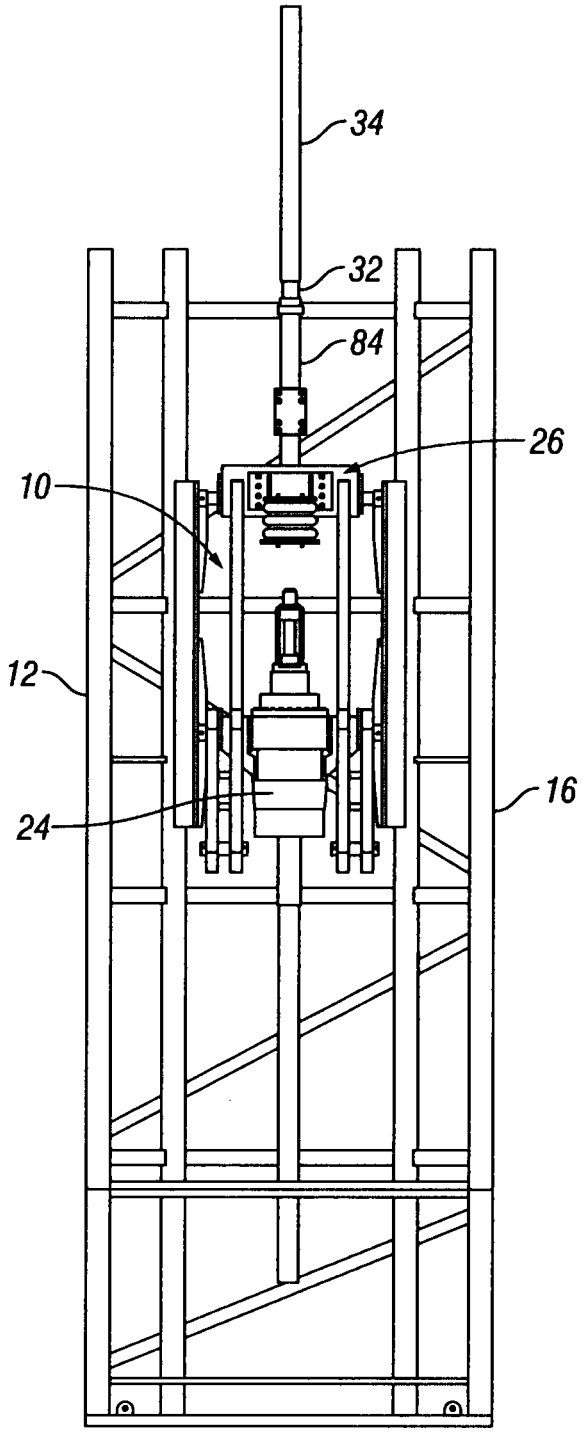
FIG. 9 is an elevational view of the top drive assembly of FIG. 8.

The top drive assembly 10 is suspended from a mover apparatus to effect the vertical movement along the guide rails 22 of the derrick 16. The mover apparatus may be a traveling block (not shown) which is in turn suspended and moved upwardly and downwardly by a line connected at its upper end to a crown block and actuated by conventional powered draw works. Alternatively, as shown in FIGS. 8 and 9, the mover apparatus may be a rod 32 of a cylinder 34 connected to the derrick 16.

Figure 3:
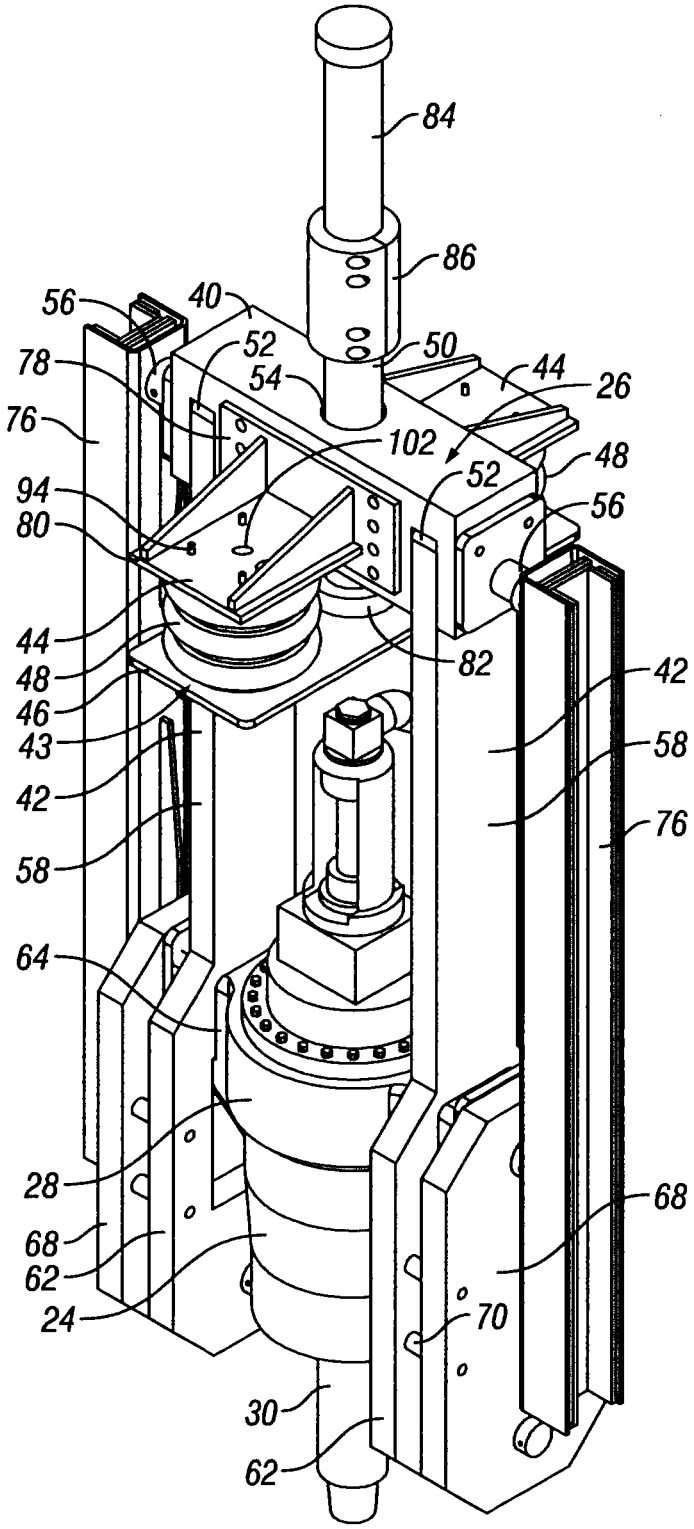
FIG. 3 is a perspective view of the top drive assembly.
Figure 5:
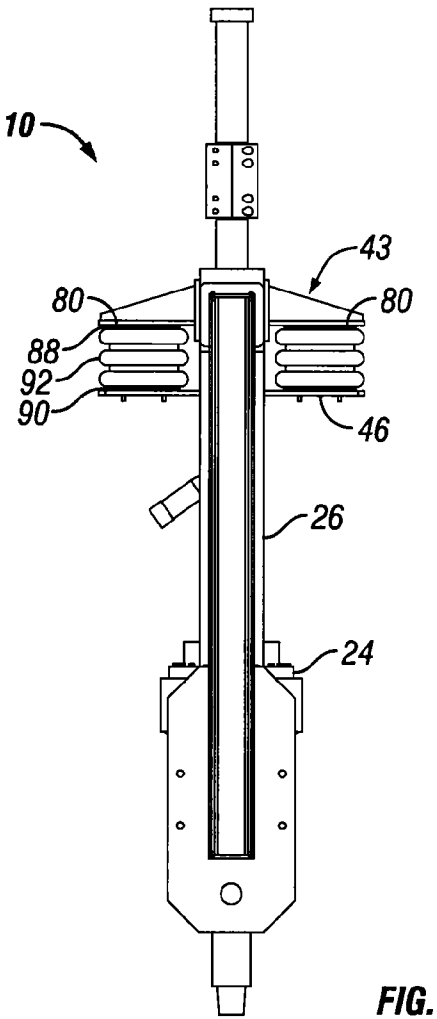
FIG. 5 is a side elevational view of the top drive assembly.
Figure 4:
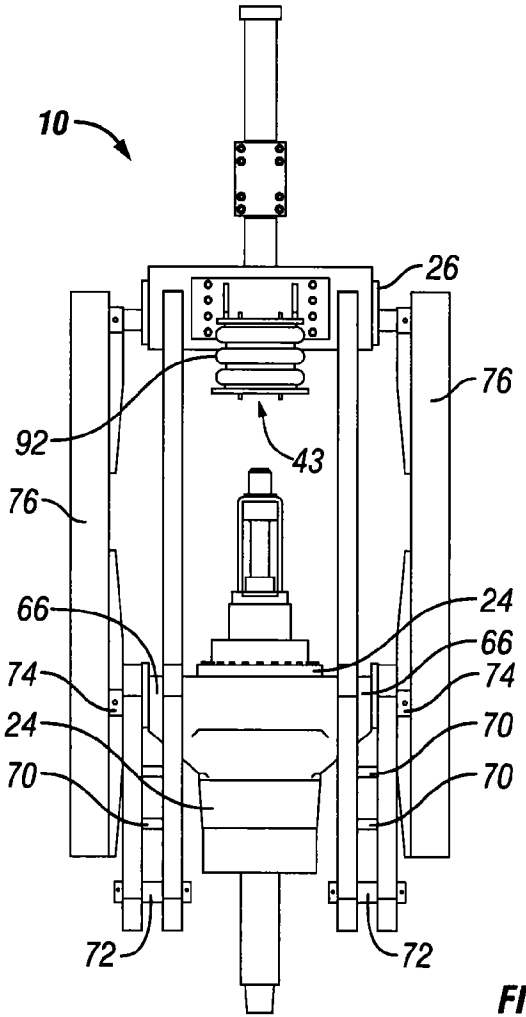
FIG. 4 is a front elevational view of the top drive assembly.
Figure 6:
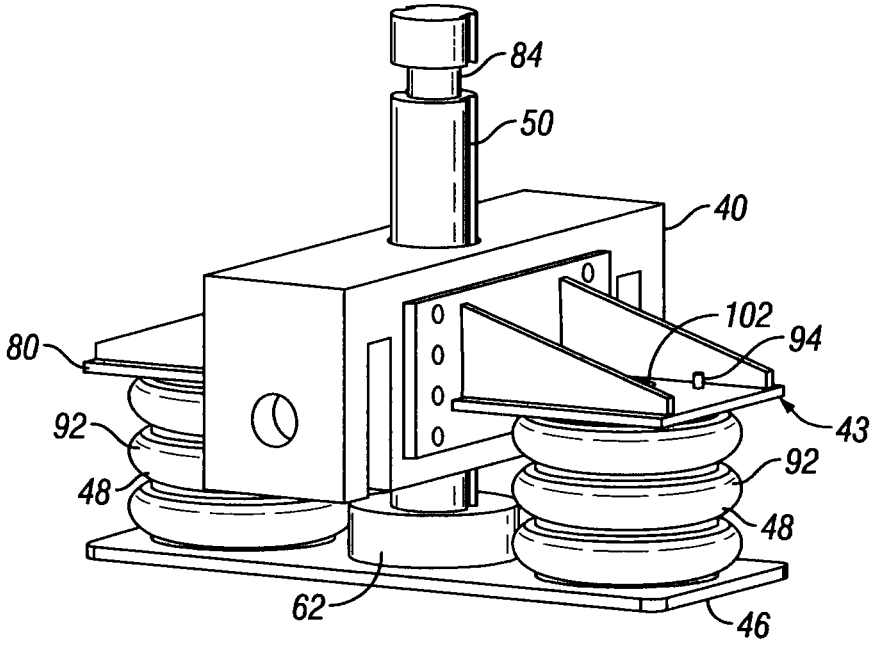
FIG. 6 is a perspective view of a portion of a force compensator shown in an expanded condition.

Referring now to FIG. 2, the force compensator 26 is connected between the power swivel 24 and the mover apparatus. The construction of the force compensator 26 is illustrated more particularly in FIGS. 3-7. With particular reference to FIGS. 3-5, the force compensator 26 comprises a carrier block 40, a pair of top drive link assemblies 42, a shock absorber assembly 43, and a traveling mandrel 50.

The carrier block 40 has a generally rectangular shape and includes a pair of slots 52 for receiving the upper ends of the top drive link assemblies 42 and a central bore 54 for slidably receiving the traveling mandrel 50. Each end of the carrier block 40 is provided with a link pen 56 which functions to connect the top drive assembly 10 to the guide rails 22 of the derrick 16 in a manner that will be described below.

The top drive link assemblies 42 include an inner plate 58 having an upper end received in one of the slots 52 of the carrier block 40 and a flared lower end 62 provided with an opening 64 for receiving a hook portion 66 of the power swivel 24. The upper end of the inner plate 58 is secured in the slot 52 of the carrier block 40 in suitable manner, such as with a pen (not shown).

The top drive link assemblies 42 further include an outer plate 68 that is similar in size and shape to the flared lower end 62 of the inner plate 58. The outer plate 68 is connected to the flared lower end 62 of the inner plate 58 in a spaced apart, parallel relationship with a plurality of connector members 70 and provided with a lower pen 72 is interposed between the inner plate 58 and the outer plate 68. The lower pens 72 of the top drive link assemblies 42 cooperate to provide locations for suspending tools, such as an elevator (not shown), when the drilling rig 12 is employed to remove drill pipe from the well in a conventional manner. The outer plate 68 is further configured to receive a link pen 74 extending from the hooked portion 66 of the power swivel 24 so that the link pen 74 protrudes from the outer plate 68. The link pen 74 is vertically aligned with the link pen 56 of the carrier block 40 so that the link pens 56 and 74 will operate to support a torque arm 76 which in turn are slidably positioned on the guide rails 22 of the derrick 16.

In one embodiment, the shock absorber assembly 43 includes a pair of upper bag supports 44, a lower bag support 46, and a pair of air bag assemblies 48 positioned between the upper and lower bag supports 44 and 46. The upper bag supports 44 are connected to either side of the carrier block 40 in a symmetrical relationship. Each upper bag support 44 has a base plate 78 that is connected to the side of the carrier block 40 and a mounting plate 80 extending in a perpendicular relationship to the base plate 78.

The lower bag support 46 is a plate positioned below the carrier block 40 between the top drive link assemblies 42 in a parallel spaced apart relationship to the mounting plates 80 of the upper bag supports 44. Accordingly, the lower bag support 46 has a length substantially equal to the combined lengths of the mounting plates 80 and the width of the carrier block 40.

The traveling mandrel 50 is slidably disposed through the central bore 54 and has a lower flanged end 82 connected to an upper end of the lower bag support 46 at a central location of the lower bag support 46. The carrier block 40 is preferably provided with a plurality of bushings (not shown) to facilitate reciprocating movement of the traveling mandrel 50 through the central bore 54 of the carrier block 40. The upper end of the traveling mandrel 50 is provided with an annular groove 84 (FIGS. 6 and 7) to facilitate the connection of the traveling mandrel 50 to the selected mover apparatus as described above. For example, the traveling mandrel 50 is shown connected to an adapter 84 with a clamp 86 to permit the top drive assembly 10 to be suspended from a traveling block (not shown). Alternatively, the traveling mandrel 50 is shown in FIGS. 8 and 9 to be connected to the rod 32 of the cylinder 34 via the adapter 84.

Figure 7:
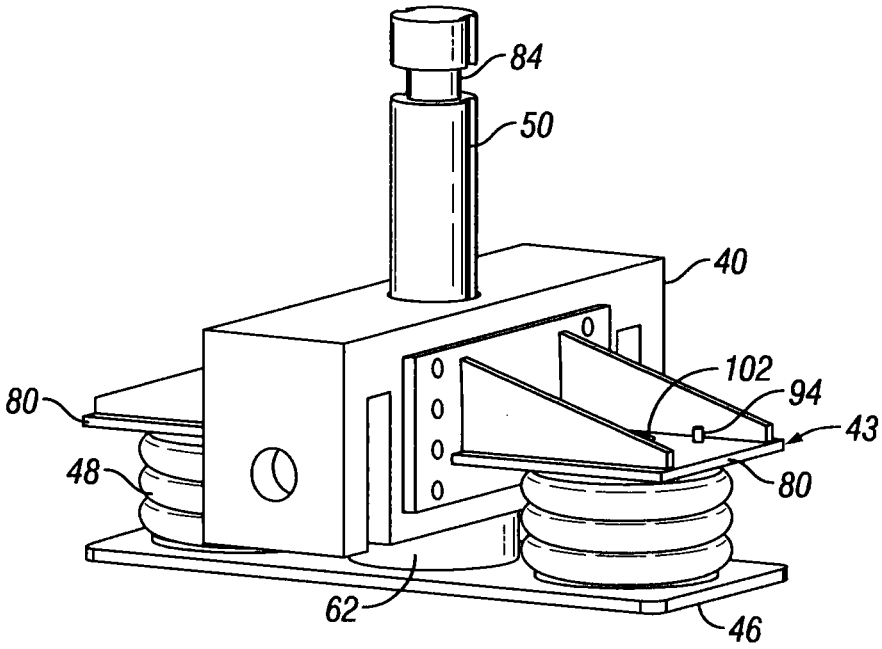
FIG. 7 is a perspective view of the force compensator of FIG. 6 shown in a compressed condition.

The airbag assemblies 48 are interposed between the upper bag support 44 and the lower bag support 46. The airbag assemblies 48 are commercially available items that include an upper bead plate 88, a lower bead plate 90, and a bellows portion 92. Extending up from each of the upper bead plates 88 is a plurality of threaded studs 94 which extend through stud-receiving apertures in the mounting plates 80, where stud nuts are screwed onto stud ends thereby securing the airbag assemblies 48 to the mounting plates 80. Similarly, extending down from each lower bead plate 90 is a plurality of threaded studs (not shown) which extend through stud-receiving apertures in the lower bag support 46, where stud nuts are screwed onto stud ends thereby securing the airbag assemblies 48 to the lower bags support 46. Further extending from each of the upper bead plates 88 is an air inlet 102 which extends through an opening in the mounting plates 80. The air inlets 102 of the airbag assemblies 48 are connected by suitable tubing to a source of compressed gas, such as an air compressor 110, and an accumulator 112 (FIG. 2) provided at the drilling rig location. A regulator 114 is interposed in the tubing between the airbag assemblies 48 and the compressor 110 to pressurize air bag assemblies 48 to a desired air pressure to permit the bellows portion 92 of the air bag assemblies 48 to move between an expanded condition (FIG. 6) and a compressed condition (FIG. 7).

In use, the airbag assemblies 48 are pressurized so that the bellows portions 92 are in an intermediate position when a single joint of drill pipe is suspended from the power swivel 24 such that the air bag assemblies 48 support the weight of the joint of drill pipe and the power swivel 24. By way of example, the airbag assemblies 48 may be pressurized to have a range of from about 13 psi to about 18 psi depending on the size of the airbag assemblies 48. Upon stabbing the joint of drill pipe into an adjacent joint of drill pipe for the purpose of making a connection, a compressive force results between the mover apparatus and power swivel 24. The compressive force in turn causes the air bag assemblies 48 to expand as the traveling mandrel 50 slides in a downward direction through the carrier block 40. As the bellows portions 92 expand, additional air pressure is provided to the airbag assemblies 48 to cause the airbag assemblies 48 to continue to support the weight of the joint of drill pipe and the power swivel 24. As the joint of drill pipe is rotated and threaded with the adjacent joint of drill pipe, the joint of the drill pipe and the power swivel 24 are drawn in a downward direction resulting in a tensile force between the mover apparatus and the power swivel 24. The tensile force in turn causes the carrier block 40 to move downwardly relative to the traveling mandrel 50 and causes the airbag assemblies 48 to compress a corresponding distance to continue supporting the weight of drill pipe and the power swivel 24. After the connection of the two joints of drill pipe is complete and the entire weight of the drill string is transferred to the top drive assembly 10, the airbag assemblies 48 are caused to compress until the lower flanged end 62 of the traveling mandrel 50 contacts and the lower side of the carrier block 40, as illustrated in FIG. 7, during drilling operations, so that the load on the power swivel 24 is transferred to the mover apparatus directly from the carrier block 40 to the traveling mandrel 50.

From the above description, it is clear that the present inventive concept are well adapted to carry out the objects and to attain the advantages mentioned herein as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. A top drive assembly for a drilling rig having a derrick and a mover assembly, comprising:

a power swivel including a drive motor and an output shaft extending downwardly from the drive motor; and a force compensator connected to the power swivel, the force compensator comprising:

a carrier block having an upper side, a lower side, a first end, a second end, a first side, a second side, and a bore extending through the carrier block from the upper side to the lower side;

a pair of top drive link assemblies positioned on either side of the power swivel and slidably positionable on a derrick of a drilling rig, each top drive link assembly having a lower end connected to the power swivel and an upper end connected to the carrier block in a way that the carrier block is positioned above the power swivel in a spaced apart relationship thereto;

a mandrel slidably disposed through the bore of the carrier block, the mandrel having an upper end and a lower end, the upper end being connectable to the mover assembly of the drilling rig; and a shock absorber assembly interposed between the carrier block and the lower end of the mandrel in such a way that the shock absorber assembly is positioned in an expanded condition when a compressive force is applied to the power swivel and the mandrel and the shock absorber assembly is positioned in a compressed condition when a tensile force is applied to the power swivel and the mandrel.

2. The top drive assembly of claim 1, wherein the shock absorber assembly comprises:

a pair of upper bag supports connected to the carrier block;

a lower bag support connected to the lower end of the mandrel; and at least two air bags interposed between the upper bag support and the lower bag support.

3. The top drive assembly of claim 2, wherein each of the air bags includes means for connecting to a source of compressed gas.

4. The top drive assembly of claim 2, wherein one of the upper bag supports is connected to the first side of the carrier block and the other upper bag support is connected to the second side of the carrier block.

5. The top drive assembly of claim 4, wherein the upper bag supports are connected on either side of the carrier block in a symmetrical relationship.

6. The top drive assembly of claim 4, wherein the lower bag support has a length substantially equal to the combined lengths of upper bag supports and a width of the carrier block.

7. The top drive assembly of claim 1, wherein the lower end of the mandrel is flanged such that the flanged end of the mandrel contacts the carrier block so as to limit the compression of the shock absorber assembly when the shock absorber assembly is in a fully compressed condition.

8. The top drive assembly of claim 1, wherein each of the top drive link assemblies comprises:

an inner plate having an upper end connected to the carrier block and a lower end connected to the power swivel;

an outer plate connected to the inner plate in a spaced apart relationship thereto; and at least one pin disposed between the lower end of the inner plate and the outer plate to define an attachment location.

9. The top drive assembly of claim 1, wherein each of the top drive link assemblies comprises:

an inner plate having an upper end connected to the carrier block and a lower end connected to the power swivel;

an outer plate connected to the inner plate in a spaced apart relationship to the inner plate; and a torque arm having an upper end connected to the carrier block and a lower end interconnected to the power swivel, the torque arm being slidably positionable on the derrick of the drilling rig.

10. A force compensator for a top drive assembly including a power swivel, comprising:

a carrier block having an upper side, a lower side, a first end, a second end, a first side, a second side, and a bore extending through the carrier block from the upper side to the lower side;

a pair of top drive link assemblies positionable on either side of the power swivel and slidably positionable on a derrick of a drilling rig, each top drive link assembly having a lower end connectable to the power swivel and an upper end connected to the carrier block in a way that the carrier block is positioned above the power swivel in a spaced apart relationship thereto when the top drive link assemblies are connected to the power swivel;

a mandrel slidably disposed through the bore of the carrier block, the mandrel having an upper end and a lower end, the upper end being connectable to a mover assembly of the drilling rig; and a shock absorber assembly interposed between the carrier block and the lower end of the mandrel in such a way that the shock absorber assembly is positioned in an expanded condition when a compressive force is applied to the top drive link assemblies and the mandrel and the shock absorber assembly is positioned in a compressed condition when a tensile force is applied to the top drive link assemblies and the mandrel.

11. The force compensator of claim 10, wherein the shock absorber assembly comprises:

a pair of upper bag supports connected to the carrier block;

a lower bag support connected to the lower end of the mandrel; and at least two air bags interposed between the upper bag support and the lower bag support.

12. The force compensator of claim 11, wherein each of the air bags includes means for connecting to a source of compressed gas.

13. The force compensator of claim 11, wherein one of the upper bag supports is connected to the first side of the carrier block and the other upper bag support is connected to the second side of the carrier block.

14. The force compensator of claim 13, wherein the upper bag supports are connected on either side of the carrier block in a symmetrical relationship.

15. The force compensator of claim 13, wherein the lower bag support has a length substantially equal to the combined lengths of upper bag supports and a width of the carrier block.

16. The force compensator of claim 10, wherein the lower end of the mandrel is flanged such that the flanged end of the mandrel contacts the carrier block so as to limit the compression of the shock absorber assembly when the shock absorber assembly is in a fully compressed condition.

17. The force compensator of claim 10, wherein each of the top drive link assemblies comprises:

an inner plate having an upper end connected to the carrier block and a lower end connectable to the power swivel;

an outer plate connected to the inner plate in a spaced apart relationship thereto; and at least one pin disposed between the lower end of the inner plate and the outer plate to define an attachment location.

18. The force compensator of claim 10, wherein each of the top drive link assemblies comprises:

an inner plate having an upper end connected to the carrier block and a lower end connected to the power swivel;

an outer plate connected to the inner plate in a spaced apart relationship to the inner plate; and a torque arm having an upper end connected to the carrier block and a lower end interconnected to the power swivel, the torque arm being slidably positionable on the derrick of the drilling rig.

* * * * *